US009510411B2

(12) United States Patent
Hayashi et al.

(10) Patent No.: US 9,510,411 B2
(45) Date of Patent: Nov. 29, 2016

(54) ILLUMINATION DEVICE

(75) Inventors: Miyo Hayashi, Osaka (JP); Hiromitsu Mizukawa, Suita (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1093 days.

(21) Appl. No.: 13/398,023

(22) Filed: Feb. 16, 2012

(65) Prior Publication Data

US 2012/0212144 A1 Aug. 23, 2012

(30) Foreign Application Priority Data

Feb. 22, 2011 (JP) ..... 2011-035790

(51) Int. Cl.
*H05B 37/00* (2006.01)
*H05B 33/08* (2006.01)

(52) U.S. Cl.
CPC ..... *H05B 33/0821* (2013.01); *H05B 33/089* (2013.01)

(58) Field of Classification Search
CPC ..... B01J 2523/00; B01J 2523/847; H01L 224/48091
See application file for complete search history.

(56) References Cited

U.S. PATENT DOCUMENTS

2006/0119308 A1* 6/2006 Weigel ..... H02P 1/445 318/778
2008/0083929 A1* 4/2008 Fan ..... H01L 27/15 257/79
2008/0143274 A1 6/2008 Itou et al.
2008/0212319 A1* 9/2008 Klipstein ..... B60Q 3/065 362/231
2009/0206762 A1* 8/2009 Gibboney ..... H05B 33/0803 315/185 R
2010/0026204 A1 2/2010 Hente et al.
2010/0194301 A1 8/2010 Okubo

FOREIGN PATENT DOCUMENTS

| | | | |
|---|---|---|---|
| CN | 101589647 | A | 11/2009 |
| CN | 101730360 | A | 6/2010 |
| EP | 2 182 780 | B1 | 5/2013 |
| JP | 2002-125367 | | 4/2002 |
| JP | 2005-176002 | | 6/2005 |
| JP | 2008-125339 | | 5/2008 |
| JP | 2010-177059 | | 8/2010 |
| JP | 2010-182883 | | 8/2010 |

OTHER PUBLICATIONS

Chinese Office Action dated Jan. 30, 2014 issued in corresponding Chinese application No. 201210040744.7 and the English translation thereof.
Chinese Office Action dated Oct. 17, 2014 issued in a corresponding Chinese application No. 2012100407447 and the English translation thereof.

* cited by examiner

*Primary Examiner* — Sibin Chen
(74) *Attorney, Agent, or Firm* — Bacon & Thomas, PLLC

(57) ABSTRACT

An illumination device includes a light emitting unit; and a lighting circuit, to which the light emitting unit is installed, for supplying an output voltage to the light emitting unit. The light emitting unit includes a light emitting element which is connected to an output terminal of the lighting circuit and emits light by the output voltage supplied from the lighting circuit; and a current limiting unit which limits a current flowing into the light emitting element portion from the lighting circuit at the time when the light emitting unit is installed to the lighting circuit.

17 Claims, 7 Drawing Sheets

ILLUMINATION DEVICE

FIELD OF THE INVENTION

The present invention relates to an illumination device including a lighting circuit and a light emitting unit.

BACKGROUND OF THE INVENTION

Recently, a light emitting diode (LED) has attracted attention as a light emitting element having a long lifespan. In the light emitting diode, it needs to control a forward current of the LED in order to maximize the performance of the LED.

Further, a large amount of current instantaneously flowing when powering, i.e., an inrush current, may not only affect circuit elements other than the LED, but also cause the noise. Accordingly, various measures have been devised in connection with the inrush current.

For example, there has been proposed a method for providing a MOS transistor in series to the LED in order to suppress a dimming noise due to the inrush current in an LED driving circuit which adjusts the luminescent brightness of the LED based on a duty ratio of a PWM signal (see, e.g., Japanese Patent Application Publication No. 2010-182883).

Further, there has been proposed, as a technology for protecting a smoothing capacitor, e.g., a technology for preventing the inrush current from flowing into the capacitor using a resistor or the like, in order to reduce damage to a circuit element due to the inrush current (see, e.g., Japanese Patent Application Publication Nos. 2008-125339 and 2002-125367).

Further, there has been proposed a method for providing a current limiting element such as a resistor and a thermistor, or a capacitor at an input circuit, in order to prevent the inrush current when a power supply voltage is inputted (see, e.g., Japanese Patent Application Publication Nos. 2010-177059 and 2005-176002)

However, the above-mentioned conventional illumination devices have a following problem. The problem of the inrush current flowing into the LED does not always occur only when turning on the power. In the LED illumination apparatus including a replaceable LED module, an inrush current due to an output voltage being outputted from the lighting circuit immediately before the LED module is installed thereto may occur at the moment when the LED module is installed to a lighting circuit.

In the installation of the LED module, particularly, in the live-wire work, the attachment and detachment of the LED module are repeated while a voltage is inputted to the input side and the lighting circuit is still operated. In this case, since the LED module is attached while a voltage on the output side of the lighting circuit is not reduced, the inrush current may flow in the LED module due to the output voltage, thereby causing damage to the LED.

SUMMARY OF THE INVENTION

The present invention provides an illumination device capable of preventing an inrush current from flowing in a light emitting unit and reducing damage to the light emitting unit although the light emitting unit is attached while a voltage on the output side of the lighting circuit is not reduced.

In accordance with an aspect of the present embodiment, there is provided an illumination device including; a light emitting unit; and a lighting circuit, to which the light emitting unit is installed, for supplying an output voltage to the light emitting unit, wherein the light emitting unit includes a light emitting element which is connected to output terminals of the lighting circuit and emits light by the output voltage supplied from the lighting circuit; and a current limiting unit which limits a current flowing into the light emitting element from the lighting circuit at the moment when the light emitting unit is installed to the lighting circuit.

According to the present invention, when the light emitting unit is attached to the lighting circuit, the current limiting unit limits the current flowing in the light emitting unit. Accordingly, although the light emitting unit is attached while the output voltage of the lighting circuit is not reduced, it is possible to prevent an inrush current from flowing into a light emitting unit, thereby reducing damage to the light emitting unit. Further, by suppressing the power consumed in the current limiting unit in a normal lighting mode, it is possible to reduce the unnecessary power consumption.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

An illumination device in accordance with embodiments of the present invention will be described with reference to the accompanying drawings which form a part hereof. The illumination device in accordance with the embodiments of the present invention is applied to an LED illumination apparatus.

(First Embodiment)

Figure 1:
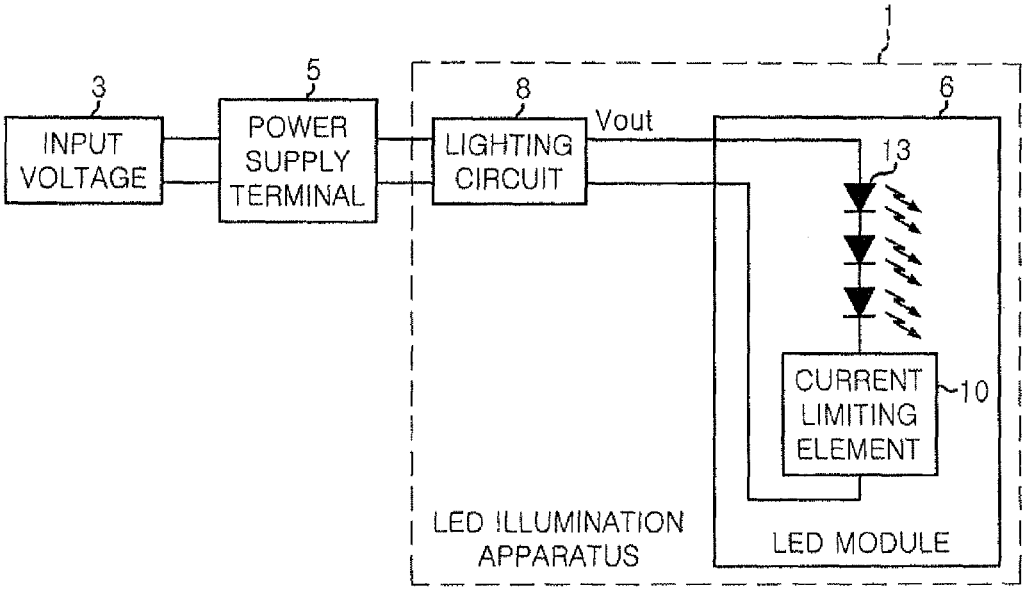
FIG. 1 schematically shows a configuration of an LED illumination apparatus in accordance with a first embodiment of the present invention.

FIG. 1 schematically shows a configuration of an LED illumination apparatus in accordance with a first embodiment of the present invention. An LED illumination apparatus 1 is detachably connected to a power supply terminal 5 to which an input voltage 3 from a commercial AC or DC power source or the like is supplied. The LED illumination apparatus 1 includes a replaceable LED module 6 and a lighting circuit 8 for driving the LED module 6.

The LED module 6 includes a plurality of LEDs (light emitting element unit) 13 connected in series to each other and a current limiting element (current limiting unit) 10 connected in series to the LEDs 13.

The lighting circuit 8 generates and supplies a voltage Vout required for driving the LED module 6 serving as a load. The lighting circuit 8 includes an AC/DC converter which rectifies the input voltage from the commercial AC power source or the like, and steps up or down the input voltage to obtain an appropriate output voltage Vout.

Further, in case of the DC power source, the lighting circuit 8 may include a DC/DC converter which steps up or down the DC input voltage to obtain an appropriate output voltage Vout.

A negative temperature coefficient (NTC) thermistor or a current regulative diode (CRD) is used as the current limiting element 10. The NTC thermistor is an element whose resistance is reduced by self-heating when a current flows to facilitate the flow of the current. The current regulative diode (CRD) is an element in which the constant current flows although the voltage changes.

Figure 2:
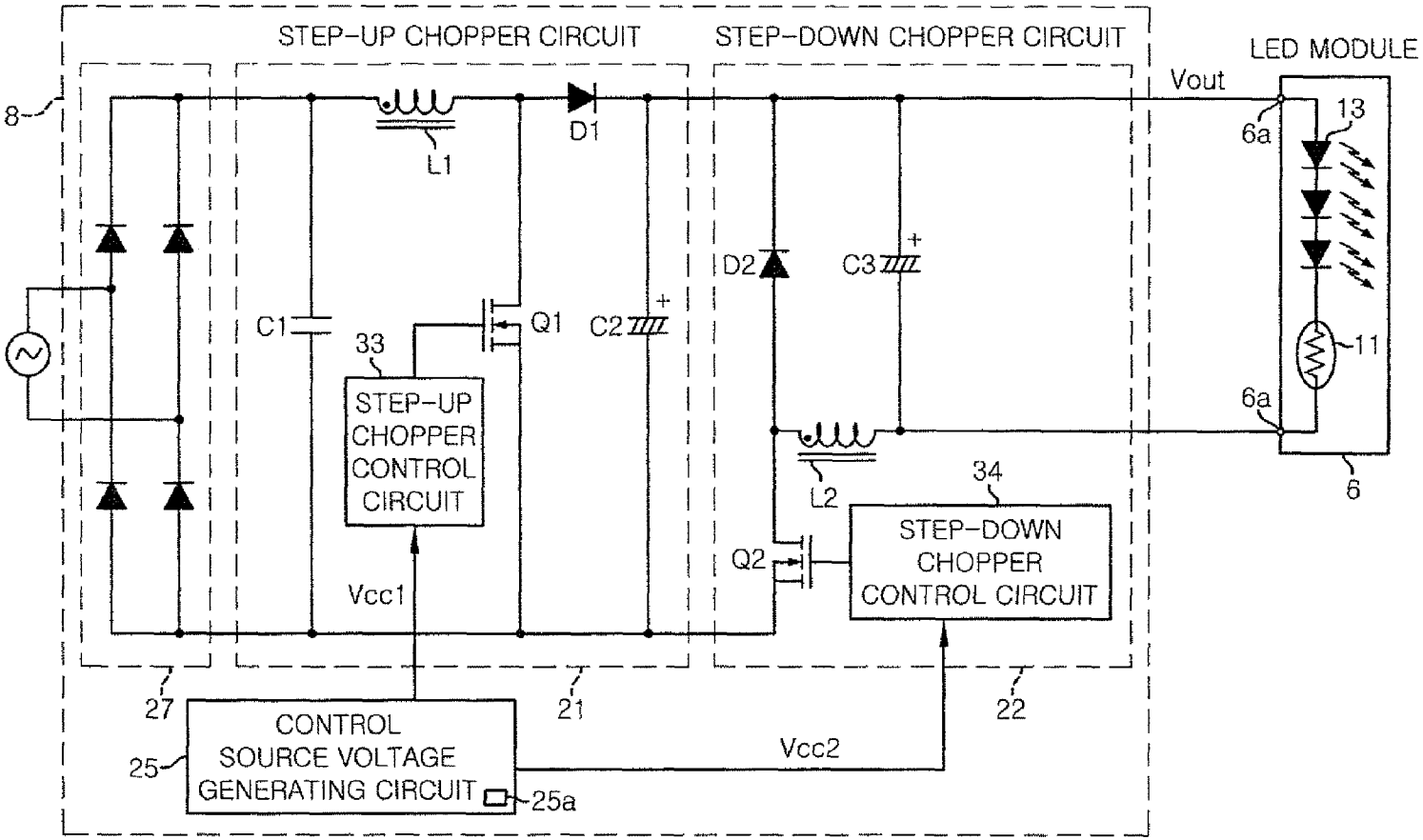
FIG. 2 is a circuit diagram showing the detailed configuration of the LED illumination apparatus of FIG. 1.

Next, a detailed configuration of the LED illumination apparatus of FIG. 1 will be described. FIG. 2 a circuit diagram showing the detailed configuration of the LED illumination apparatus shown in FIG. 1.

The lighting circuit 8 includes a diode bridge rectifying circuit (DB) 27 which rectifies an alternating current supplied as an input voltage, a step-up chopper circuit 21 which smoothes a ripple current after rectification and steps up the input voltage, and a step-down chopper circuit 22 which steps down the stepped-up voltage.

Further, the lighting circuit 8 includes a control source voltage generating circuit 25 which generates a control source voltage that is supplied to the step-up chopper circuit 21 and the step-down chopper circuit 22.

An input of the step-up chopper circuit 21 is connected to the diode bridge rectifying circuit 27.

The step-up chopper circuit 21 includes a smoothing capacitor C1, a choke coil L1, a switching element Q1 consisting of a N channel MOSFET, a diode D1, an electrolytic capacitor C2, and a step-up chopper control circuit 33.

The smoothing capacitor C1 smoothes a signal rectified by the diode bridge rectifying circuit 27. The choke coil L1 generates an induced current caused by an on/off operation of the switching element Q1. The induced current is rectified by the diode D1 and charges are accumulated in the electrolytic capacitor C2.

When the step-up chopper control circuit 33 receives a control source voltage Vcc1 from the control source voltage generating circuit 25, it outputs a pulse signal having a duty ratio corresponding to the control source voltage Vcc1 to the switching element Q1, thereby turning on/off the switching element Q1. The on/off operation is performed according to the duty ratio, and the stepped-up voltage is outputted from the step-up chopper circuit 21.

Meanwhile, an input of the step-down chopper circuit 22 is connected to an output of the step-up chopper circuit 21. The step-down chopper circuit 22 includes a switching element Q2 consisting of a N channel MOSFET, a choke coil L2, a diode D2, an electrolytic capacitor C3, and a step-down chopper control circuit 34.

The choke coil L2 generates an induced current caused by an on/off operation of the switching element Q2. The thus induced current is rectified by the diode D2 and charges are accumulated in the electrolytic capacitor C3.

When the step-down chopper control circuit 34 receives a control source voltage Vcc2 from the control source voltage generating circuit 25, the step-down chopper control circuit 34 outputs a pulse signal having a duty ratio corresponding to the control source voltage Vcc2 to the switching element Q2, thereby turning on/off the switching element Q2.

The on/off operation is performed according to the duty ratio, and the stepped-down voltage is outputted from the step-down chopper circuit 22.

As described above, by installing the step-up chopper circuit 21 at the first stage of the lighting circuit 8, it is possible to achieve a high power factor and a wide range of the input voltage.

Further, by installing the step-down chopper circuit 22 at the second stage of the lighting circuit 8, it is possible to supply an appropriate output voltage to the LED module 6.

The control source voltage generating circuit 25 has an adjustment knob 25*a* for, freely varying the control source voltages Vcc1 and Vcc2. The adjustment knob 25*a* enables the adjustment of the illuminance of light emitted from the LED module 6. Further, in a case where dimming control is not performed, the control source voltages Vcc1 and Vcc2 are fixed at constant values.

The LED module 6 includes, as described with reference to FIG. 1, the LEDs 13 connected in series to each other, and a NTC thermistor 11 connected in series to the LEDs 13. The NTG thermistor 11 serves as the current limiting element 10.

Further, the LED module 6 has a power terminal 6*a* which is detachably connected to the lighting circuit 8.

In the LED illumination apparatus 1 having the above configuration, there will be described a case where the LED module 6 is installed to the lighting circuit 8 immediately after turning off the light, or in a conducting state (i.e., live-wire state).

When the power terminal 6*a* of the LED module 6 is connected to the lighting circuit 8, the output voltage Vout from the lighting circuit 8 is applied to the LED module 6. At this point, since the temperature of the LED module 6 is regarded as room temperature immediately after attachment, the resistance of the NTC thermistor 11 is high.

Further, the resistance of the NTC thermistor 11 at room temperature is set to be a high value as compared with the resistance of the LEDs 13, in order to prevent an inrush current from flowing into the LEDs 13.

Thus, since the total resistance of the LED module 6 in which the NTC thermistor 11 having a high resistance is connected in series to the LEDs 13 is also high, the inrush current flowing into the LEDs 13 is limited immediately after installation.

When being installed and turned on, after a moment, the LED module 6 operates in a normal lighting mode where a stabilized output current is applied from the lighting circuit to the LED module 6. Accordingly, the resistance of the NTC thermistor 11 decreases by self-heating of the NTC thermistor 11.

Accordingly, the power consumption in the LEDs 13 increases and an unnecessary power consumed in the NTC thermistor 11 is reduced.

As described above, in accordance with the LED illumination apparatus of the first embodiment, even when the LED module is installed while a output voltage from the lighting circuit is not yet sufficiently reduced in the live-wire work or the like, it is possible to prevent an inrush current from flowing in the LEDs, thereby reducing damage to the LEDs.

Further, by suppressing the power consumed in the NTC thermistor serving as the current limiting element a normal lighting mode, it is possible to reduce the unnecessary power consumption.

(Second Embodiment)

The case where the current limiting element is connected in series to a plurality of LEDs has been described in the first embodiment.

A case where the current limiting element is connected in parallel to a plurality of LEDs will be described in a second embodiment.

Figure 3:
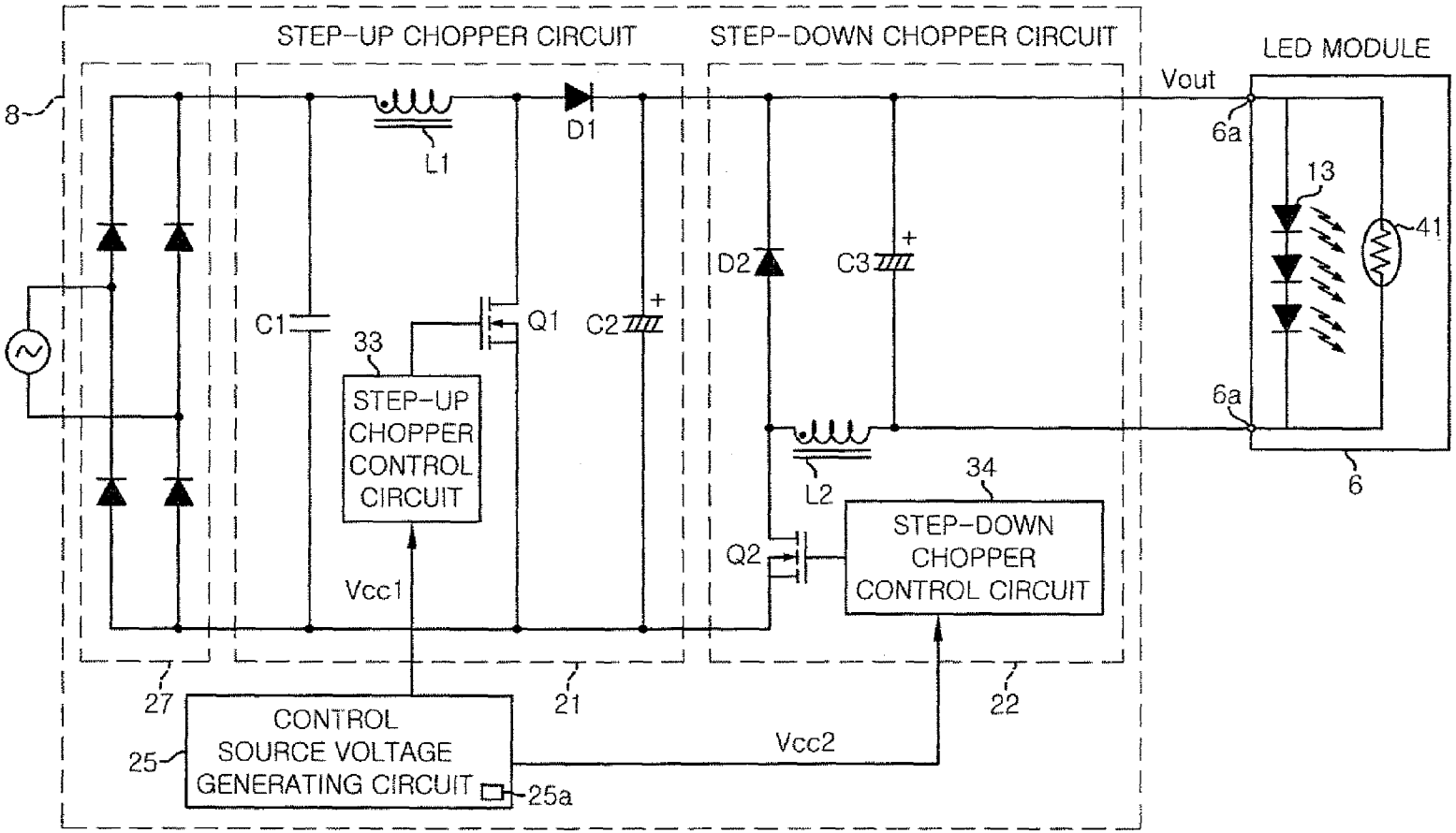
FIG. 3 illustrates a circuit diagram showing a configuration of an LED illumination apparatus in accordance with a second embodiment of the present invention.

FIG. 3 is a circuit diagram showing a configuration of an LED illumination apparatus in accordance with the second embodiment of the present invention. The same reference numerals are assigned to the same components as those of the first embodiment, and a description thereof will be omitted.

In the second embodiment, the LED module 6 includes a plurality of LEDs 13 connected in series to each other, and a positive temperature coefficient (PTC) thermistor 41 connected in parallel to the LEDs 13.

The PTC thermistor 41 is an element whose resistance increases by self-heating when a current flows to thereby make it difficult for the current to flow. That is, the PTC thermistor 41 serves as the current limiting element.

The lighting circuit 8 has the same configuration and operation as those of the first embodiment. That is, the step-up chopper circuit 21 is provided at the first stage of the lighting circuit 8 to achieve a high power factor and a wide range of the input voltage. Further, the step-down chopper circuit 22 is provided at the second stage of the lighting circuit 8 to supply an appropriate output voltage to the LED module 6.

There will be described a case where the LED module 6 is installed to the lighting circuit 8 immediately after turning off the light, or in a power-on state (live-wire state).

When the power terminal 6*a* of the LED module 6 is coupled to the lighting circuit 8, the output voltage Vout of the lighting circuit 8 is applied to the LED module 6. At this point, since the temperature of the LED module 6 is regarded as room temperature immediately after installation, the resistance of the PTC thermistor 41 is low. Further, the resistance of the PTC thermistor 41 at room temperature is set to be a low value as compared with the resistance of the LEDs 13, which can reduce an inrush current flowing into the LEDs 13.

In the LED module 6 in which the PTC thermistor 41 having a low resistance is connected in parallel to the LEDs 13, immediately after installation, an inrush current flows to the PTC thermistor 41 having a low resistance from the lighting circuit 8 such that the inrush current can be prevented from flowing into the LEDs 13.

When the LED module 6 is installed and is turned on, the LED module 6 operates in a normal lighting mode after a while, and the resistance of the PTC thermistor 41 increases by self-heating thereof. Accordingly, a large amount of current flows to the LEDs 13, the power consumption of the LEDs 13 becomes large, and the unnecessary power consumption in the PTC thermistor 41 is reduced.

with the LED illumination apparatus of the second embodiment, as with the first embodiment, although the LED module is installed while a voltage on the output side of the lighting circuit is not reduced in the live-wire work or the like, it is possible to prevent an inrush current from flowing in the LEDs and reduce damage to the LEDs.

Further, in accordance with the LED illumination apparatus of the second embodiment, the inrush current flows in the PTC thermistor immediately after the installation, but the rapid temperature rise in the PTC thermistor is expected by self-heating. Accordingly, it is possible to increase responsiveness when turning on the LED module.

(Third Embodiment)

The cases where the NTC thermistor and the FTC thermistor as the current limiting elements are respectively connected in series and in parallel to LEDs have been described in the first and second embodiments. A case where, instead of the thermistor as a current limiting element, a switch circuit is connected to LEDs will be described in a third embodiment.

Figure 4:
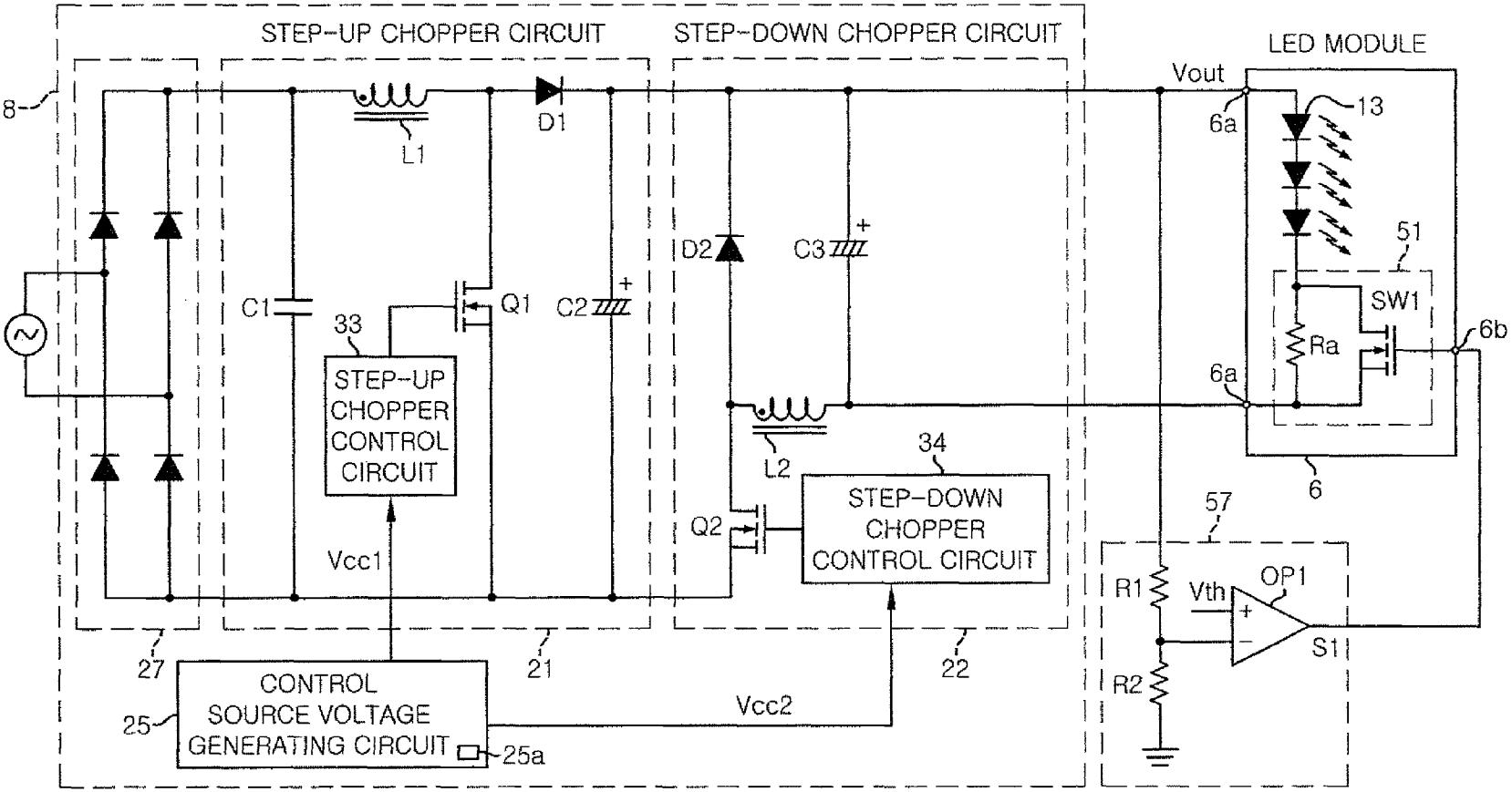
FIG. 4 illustrates a circuit diagram showing configuration of an LED illumination apparatus in accordance with a third embodiment of the present invention.

FIG. 4 a circuit diagram illustrating a configuration of an LED illumination apparatus in accordance with the third embodiment of the present invention. The same reference numerals are assigned to the same components as those of the first embodiment, and a description thereof will be omitted.

The lighting circuit 8 has the same configuration and operation as those of the first embodiment. That is, the step-up chopper circuit 21 is provided at the first stage in the lighting circuit 8 to achieve a high power factor and a wide range of the input voltage. Further, the step-down chopper circuit 22 is provided at the second stage in the lighting circuit 8 to supply an appropriate output voltage to the LED module 6.

In the third embodiment, the LED module 6 includes a plurality of LEDs 13 and a switch circuit 51 connected in series thereto. The switch circuit 51 has a resistor Ra connected in series to the LEDs 13, and a switching element SW1 connected in parallel to the resistor Ra and constituted by an N channel MOSFET which is driven by a signal from a load removal detection unit 57 as will be described later. The resistor Ra is provided to have a higher resistance than that of the LEDs 13 which makes it difficult for an inrush current to flow into the LEDs 13.

The load removal detection unit 57 is provided at the output terminal of the lighting circuit 8 to detect the removal of the LED module 6 serving as a load. The load removal detection unit 57 has a comparator OP1 consisting of an operational amplifier.

A threshold Vth is inputted to a positive (+) input terminal of the comparator OP1.

Meanwhile, a voltage, into which the output voltage Vout of the lighting circuit 8 is divided by resistors R1 and R2, is inputted to a negative (−) input terminal of the comparator OP1.

Further, an output terminal of the comparator OP1 is connected to a signal terminal 6*b* connected to a gate of the switching element SW1. Thus, when the power terminal 6*a* of the LED module 6 is coupled to the lighting circuit 8, a signal S1 is inputted to the switching element SW1 from the output terminal of the comparator OP1.

Figure 5:
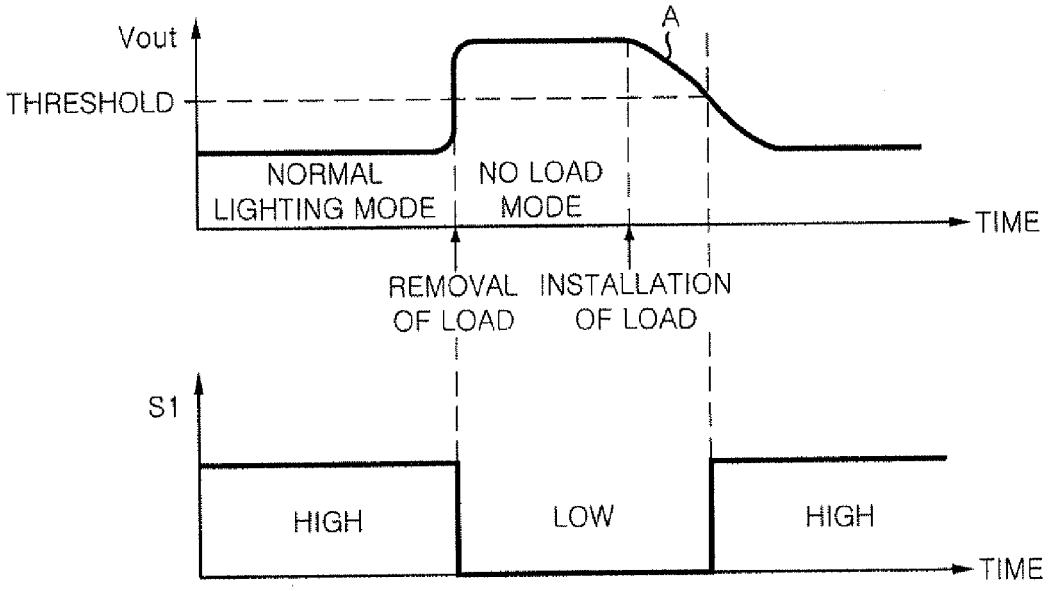
FIG. 5 is a graph showing an operation of a load removal detection unit.

Next, an operation of the load removal detection unit (switch control unit) 57 will be described. FIG. 5 is a graph for explaining the operation of the load removal detection unit 57.

When the LED module 6 is removed from the lighting circuit 8, the current in the LED module 6 stops flowing. Accordingly, the output voltage Vout from the lighting circuit 8 (voltage of the step-down chopper circuit) becomes higher than that in a normal lighting mode.

When the output voltage Vout inputted to the negative (−) input terminal of the comparator OP1 exceeds the threshold Vth, the signal S1 outputted from the comparator OP1 becomes a low level. Accordingly, the N channel MOSFET as the switching element SW1 is turned off.

Then, when the LED module 6 is installed to the lighting circuit 8, the output voltage Vout of the lighting circuit 8 decreases from a voltage in a no load mode to a voltage in a normal lighting mode with time (see line A in FIG. 5).

In this case, the signal S1 outputted from the comparator OP1 does not change to a low level until the voltage inputted to the (−) input terminal of the comparator CP1 becomes lower than a predetermined voltage corresponding to the threshold Vth of the comparator OP1.

Accordingly, an N channel MOSFET as the switching element SW1 maintains an OFF state. Further, since the switching element SW1 is turned off, the current flowing in the LEDs 13 upon installing the LED module 6 is limited by the resistor Ra.

When the voltage inputted to the negative (−) input terminal of the comparator OP1 becomes lower than the threshold Vth, as in a normal lighting mode before removal, the signal S1 of the comparator OP1 has a high level again.

Further, the N channel MOSFET as the switching element SW1 is turned on and the resistor Ra is bypassed to reduce the unnecessary power consumption therein.

As described above, with the LED illumination apparatus of the third embodiment, the switching element SW1 connected in parallel to the resistor Ra is turned off in the installation. Therefore, the resistor Ra can prevent an inrush current flowing into the LEDs, thereby reducing damage to the LEDs.

Further, in the LED illumination apparatus of the third embodiment, the switching element SW1 turns on in a normal lighting mode, and the resistor Pa is bypassed to reduce the unnecessary power consumption in the resistor Pa.

(Fourth Embodiment)

The case where a switch circuit is connected in series to a plurality of LEDs has been described in the third embodiment. A case where a switch circuit is connected in parallel to a plurality of LEDs will be described in a fourth embodiment.

Figure 6:
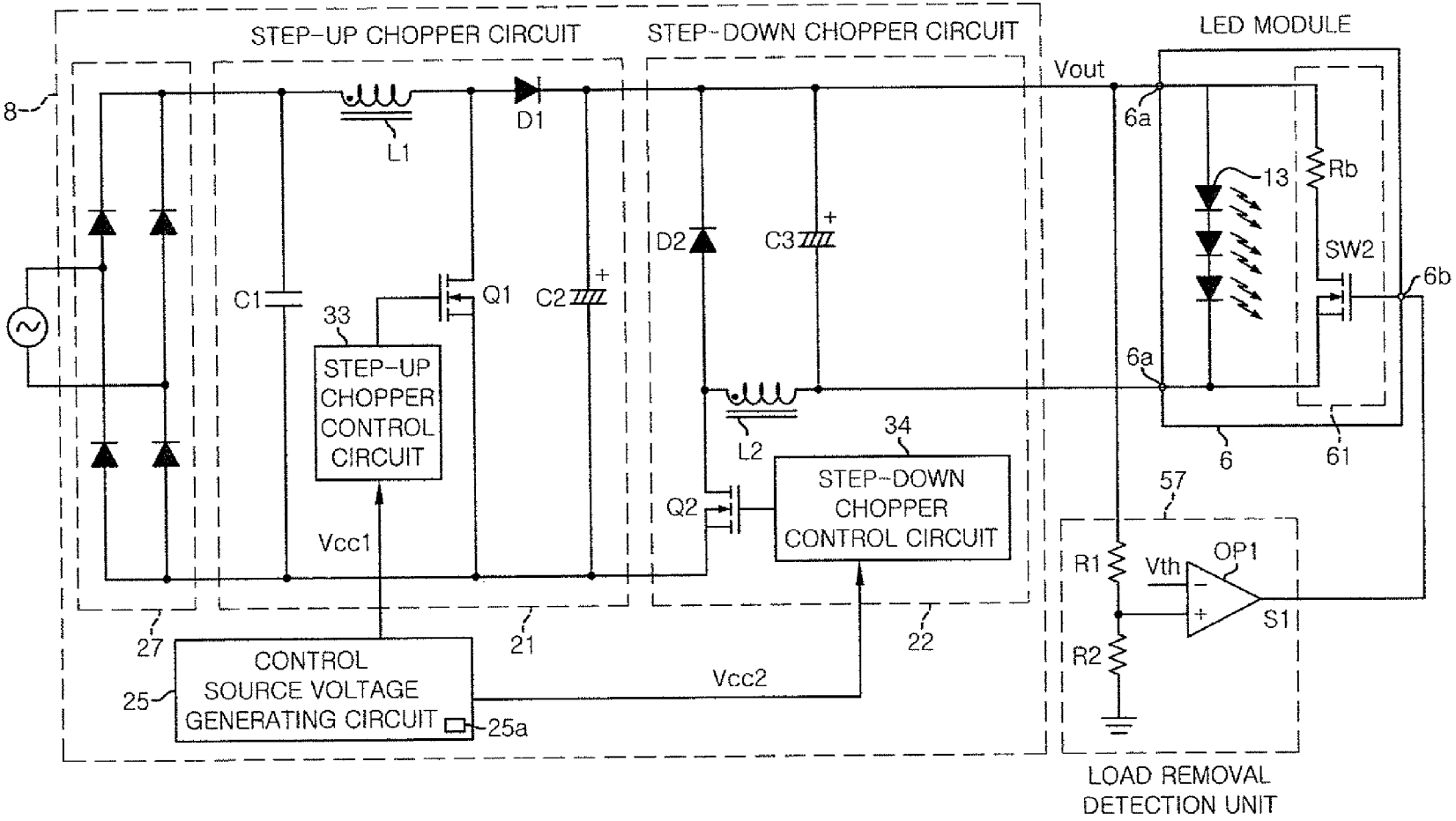
FIG. 6 illustrates a circuit diagram showing a configuration of an LED illumination apparatus in accordance with a fourth embodiment of the present invention.

FIG. 6 is a circuit diagram depicting a configuration of an LED illumination apparatus in accordance with the fourth embodiment of the present invention. The same reference numerals are assigned to the same components as those of the third embodiment, and a description thereof will be omitted.

The lighting circuit 8 has the same configuration and operation as those of the first embodiment. That is, the step-up chopper circuit 21 is provided at the first stage of the lighting circuit 8 to achieve a high power factor and a wide range of the input voltage. Further, the step-down chopper circuit 22 is provided at the second stage of the lighting circuit ,8 to supply an appropriate output voltage to the LED module 6.

In the fourth embodiment, the LED module 6 includes a plurality of LEDs 13 and a switch circuit 61 connected in parallel thereto.

The switch circuit 61 has a resistor Rb connected in parallel to the LEDs 13, and a switching element SW2 connected in series to the resistor Rb and constituted by an N channel MOSFET operating based on a signal from the load removal detection unit 57.

The resistor Rb has a resistance value lower than that of the LEDs 13, which facilitates flowing of an inrush current into the resistor Rb.

As in the third embodiment, the load removal detection unit 57 is provided at the output terminal of the lighting circuit 8 to thereby detect the removal of the LED module 6 serving as a load. The load removal detection unit 57 has a comparator OP1 including an operational amplifier.

In the present embodiment, differently from the third embodiment, the threshold Vth is inputted to the negative (−) input terminal of the comparator OP1. Meanwhile, the output voltage Vout of the lighting circuit 8 is divided by a ratio of the resistors R1 and R2, and a thus divided voltage is inputted to a positive (+) input terminal of the comparator OP1.

An output terminal of the comparator OP1 is connected to a signal terminal 6*b* coupled to a gate of the switching element SW2. When the LED module 6 is coupled to the lighting circuit 8, a signal S1 from the output terminal of the comparator OP1 is inputted to the switching element SW2.

Figure 7:
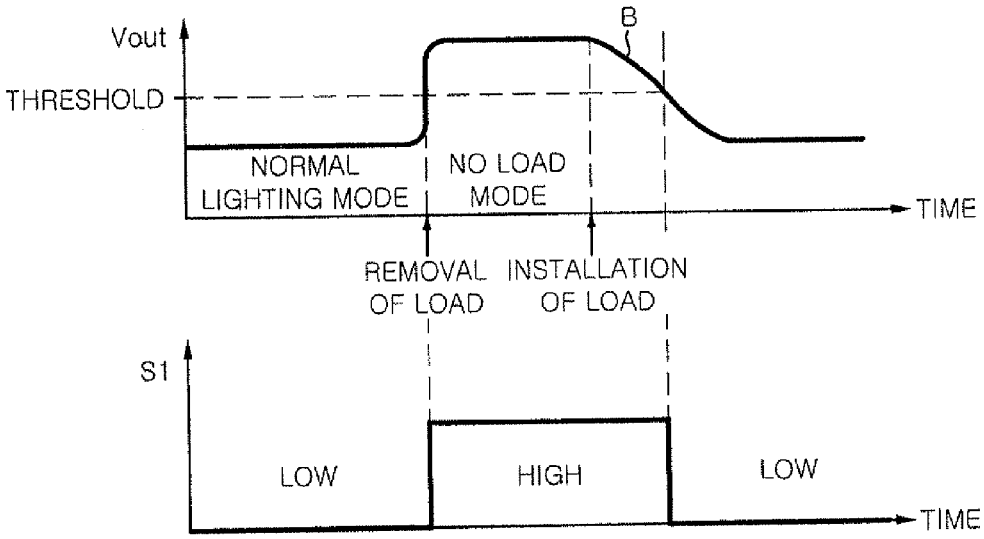
FIG. 7 is a graph showing an operation of a load removal detection unit.

Next, an operation of the load removal detection unit will be described. FIG. 7 is a graph showing the operation of the load removal detection unit 57.

When the LED module 6 is removed from the lighting circuit 8, the current in the LED module 6 stops flowing, a voltage (voltage of the step-down chopper circuit) higher than that in a normal lighting mode is outputted as the output voltage Vout from the lighting circuit 8.

When the voltage inputted to the positive (+) input terminal of the comparator OP1 exceeds the threshold Vth, the signal S1 outputted from the comparator OP1 has a high level. Accordingly, the switching element SW2 consisting of an N channel MOSFET is turned on.

Then, when the LED module 6 is installed to the lighting circuit 8, the output voltage Vout of the lighting circuit 8 decreases from a voltage in a no load mode to a voltage in a normal lighting mode with time (see line B in FIG. 7).

Further, the signal S1 outputted from the comparator OP1 does not rise up to a high level until the voltage inputted to the (+) input terminal of the comparator OP1 becomes lower than the threshold Vth of the comparator OP1.

Thus, the switching element SW2 consisting of an N channel MOSFET maintains an ON state. Accordingly, most of the current inputted to the LED module 6 bypasses the LEDs 13 and flows into the resistor Rb having a relatively low resistance. As a result, the current flowing in the LEDs 13 is limited.

When the voltage inputted to the positive (+) input terminal of the comparator OP1 becomes lower than the threshold Vth, as in a normal lighting mode before removal, the signal. S1 outputted from the comparator OP1 has a low level again. Accordingly, the current flowing in the resistor Rb connected in parallel to the LEDs 13 is cut off to thereby reduce the unnecessary power consumption in the resistor Rb.

As described above, with the LED illumination apparatus of the fourth embodiment, the switching element SW2 connected in series to the resistor Rb is turned on in the installation. Therefore, the inrush current inputted into the LED module 6 flows also to the resistor Rb, which can prevent the inrush current flowing in the LEDs and reduce damage to the LEDs.

Further, in the LED illumination apparatus of the fourth embodiment, the switching element SW2 is turned off in a normal lighting mode, and a path of the current flowing into the resistor Rb is eliminated. As a result, the unnecessary power consumption can be reduced in the resistor Rb.

Further, the present invention is not limited to the configurations of the above-described embodiments, and may have any configuration capable of achieving functions described in claims or functions of the above-described embodiments.

For example, the step-up chopper circuit is used at the first stage of the lighting circuit and the step-down chopper circuit is used at the second stage of the lighting circuit in the first to fourth embodiments. However, a capacitive input circuit instead of a choke input type circuit may be used at the first stage. Further, the step-up chopper circuit may be used at the second stage according to the input and output voltages. Further, the input voltage may be a DC voltage. In this case, the circuit at the first stage becomes unnecessary. The same may be applied to the circuit at the second stage.

Although the NTC thermistor is used as the current limiting element in the first embodiment, it is not limited thereto, and a current regulative diode (CRD) may be used as the current limiting element.

Although the resistor is used as the current limiting element in the third and fourth embodiments, it is not limited thereto, and a resistor element such as a positive temperature coefficient (PTC) thermistor may be used as the current limiting element.

Although the N channel MOSFET is used as the switching element in the third and fourth embodiments, it is not limited thereto, and an N type transistor, a relay switch or the like may be used as the switching element.

Further, in the third embodiment, the output voltage Vout is inputted to the negative (−) input terminal of the comparator OP1. However, it may be configured in such a way that the output voltage Vout is inputted to the positive (+) input terminal, and, as the switching element, a P channel MOSFET or P type transistor is used instead of the N channel MOSFET.

In the same way, in the fourth embodiment, the output voltage Vout is inputted to the positive (+) input terminal of the comparator OP1. However, it may be configured in such a way that the output voltage Vout is inputted to the negative (−) input terminal, and, as the switching element, a P channel MOSFET or P type transistor is used instead of the N channel MOSFET.

Further, although the comparator is used as the load removal detection unit 57 in the third and fourth embodiments, any configuration capable of detecting the removal of the load may be used. For example, the detection may be performed by using a mechanical switch instead of an electronic part.

While the invention has been shown and described with respect to the embodiments, it will be understood by those skilled in the art that various changes and modification may be made without departing from the scope of the invention as defined in the following claims.

What is claimed is:

1. An illumination device comprising:

a light emitting unit; and a lighting circuit, to which the light emitting unit is installed, for supplying a direct current (DC) output voltage to the light emitting unit, wherein the light emitting unit includes a light emitting element which is connected to output terminals of the lighting circuit and emits light by the DC output voltage supplied from the lighting circuit; and a current limiting unit which limits a current flowing into the light emitting element from the lighting circuit at the moment when the light emitting unit is installed to the lighting circuit;

wherein the current limiting unit does not limit the current flowing into the light emitting element from the lighting circuit in a normal lighting mode;

wherein the current flowing into the light emitting element at the moment when the light emitting unit is installed to the lighting circuit is smaller than a current flowing into the light emitting element in the normal lighting mode; and wherein the light emitting unit further includes a power terminal detachably connected to the lighting circuit.

2. The illumination device of claim 1, wherein the current limiting unit is an element which is connected in series to the light emitting element, and whose resistance is high at the moment when installing and low in the normal lighting mode.

3. The illumination device of claim 2, wherein the light emitting element includes a plurality of light emitting diodes connected in series.

4. The illumination device of claim 1, wherein the current limiting unit is an element which is connected in parallel to the light emitting element, and whose resistance is low at the moment when installing and high in the normal lighting mode.

5. The illumination device of claim 4, wherein the light emitting element includes a plurality of light emitting diodes connected in series.

6. The illumination device of claim 1, wherein the current limiting unit is a switch circuit which is connected in series to the light emitting element and includes a switching element and a resistor element connected in parallel to each other, and wherein the switching element turns off at the moment when installing the light emitting unit such that the light emitting element is connected to the lighting circuit through the resistor element, and turns on in the normal lighting mode such that the resistor element is bypassed.

7. The illumination device of claim 6, further comprising a switch control unit which controls to turn on and off the switching element, wherein the DC output voltage of the lighting circuit decreases from a voltage in a no-load mode to a voltage in the normal lighting mode with time after the light emitting unit is installed to the lighting circuit, and the switch control unit switches over the switching element when the DC output voltage of the lighting circuit becomes lower than a threshold.

8. The illumination device of claim 6, wherein the light emitting element includes a plurality of light emitting diodes connected in series.

9. The illumination device of claim 7, wherein the light emitting element includes a plurality of light emitting diodes connected in series.

10. The illumination device of claim 1, wherein the current limiting unit is a switch circuit which is connected in parallel to the light emitting element and includes a switching element and a resistor element connected in series to each other, and wherein the switching element turns on at the moment when installing the light emitting unit such that the resistor element is connected to the lighting circuit and the light emitting element is bypassed, and turns off in the normal lighting mode such that the resistor element is disconnected from the lighting circuit.

11. The illumination device of claim 10, further comprising a switch control unit which controls to turn on and off the switching element, wherein the DC output voltage of the lighting circuit decreases from a voltage in a no-load mode to a voltage in the normal lighting mode with time after the light emitting unit is installed to the lighting circuit, and the switch control unit switches over the switching element when the DC output voltage of the lighting circuit becomes lower than a threshold.

12. The illumination device of claim 10, wherein the light emitting element includes a plurality of light emitting diodes connected in series.

13. The illumination device of claim 11, wherein the light emitting element includes a plurality of light emitting diodes connected in series.

14. The illumination device of claim 1, wherein the light emitting element includes a plurality of light emitting diodes connected in series.

15. The illumination device of claim 1, wherein the light emitting element includes a plurality of light emitting diodes connected in series.

16. An illumination device comprising:

a light emitting unit;

a lighting circuit, to which the light emitting unit is installed, for supplying a direct current (DC) output voltage to the light emitting unit, wherein the light emitting unit includes a light emitting element which is connected to output terminals of the lighting circuit and emits light by the DC output voltage supplied from the lighting circuit; and a current limiting unit which limits a current flowing into the light emitting element from the lighting circuit at the moment when the light emitting unit is installed to the lighting circuit, wherein the light emitting unit further includes a power terminal detachably connected to the lighting circuit, and wherein the current limiting unit is an NTC (negative temperature coefficient) thermistor which is connected in series to the light emitting element;

wherein the current limiting unit does not limit the current flowing into the light emitting element from the lighting circuit in a normal lighting mode; and wherein the current flowing into the light emitting element at the moment when the light emitting unit is installed to the lighting circuit is smaller than a current flowing into the light emitting element in the normal lighting mode.

17. The illumination device of claim 16, wherein the light emitting element includes a plurality of light emitting diodes connected in series.

* * * * *